US008132374B2

(12) United States Patent
Lee et al.

(10) Patent No.: US 8,132,374 B2
(45) Date of Patent: Mar. 13, 2012

(54) EXTERNAL WALL PANEL UNIT FOR SAVING ENERGY AND EXTERNAL WALL STRUCTURE SYSTEM USING THE SAME

(75) Inventors: Sang Leem Lee, Seoul (KR); Hee Sung Kang, Seoul (KR); Nam Kyu Park, Seoul (KR); Young A Park, Seoul (KR); Gi Hong Jeong, Seoul (KR); Jong Hee Lee, Seoul (KR); Sung Jin Baek, Seoul (KR); Seung Bok Leigh, Seoul (KR)

(73) Assignee: Space Architectural Design Co., Ltd. (KR)

( * ) Notice: Subject to any disclaimer, the term of this patent is extended or adjusted under 35 U.S.C. 154(b) by 45 days.

(21) Appl. No.: 12/849,735

(22) Filed: Aug. 3, 2010

(65) Prior Publication Data

US 2011/0203196 A1 Aug. 25, 2011

(30) Foreign Application Priority Data

Jan. 28, 2010 (KR) ..... 10-2010-0007886

(51) Int. Cl.
*E04F 17/00* (2006.01)
*F24F 7/00* (2006.01)

(52) U.S. Cl. ..... 52/173.3; 52/209; 52/235; 52/302.1; 126/628; 165/48.2; 454/196

(58) Field of Classification Search ..... 52/1, 173.1, 52/173.3, 235, 302.1; 126/628, 629, 633; 137/357, 360; 165/48.1, 48.2; 454/196, 454/211, 215
See application file for complete search history.

(56) References Cited

U.S. PATENT DOCUMENTS

| | | | | |
|---|---|---|---|---|
| 4,092,979 | A * | 6/1978 | Kotlarz | 126/628 |
| 4,611,447 | A * | 9/1986 | Krechel | 52/209 |
| 5,944,011 | A * | 8/1999 | Breslin | 126/633 |
| 7,134,247 | B2 * | 11/2006 | Ting | 52/235 |
| 2003/0177699 | A1 * | 9/2003 | Fukuro et al. | 49/408 |
| 2007/0227531 | A1 * | 10/2007 | Garcia Cors et al. | 126/622 |
| 2011/0017301 | A1 * | 1/2011 | Canavan | 137/1 |

FOREIGN PATENT DOCUMENTS

| | | |
|---|---|---|
| JP | 2005232745 | 9/2005 |
| JP | 2007291661 | 11/2007 |

* cited by examiner

*Primary Examiner* — Robert Canfield
(74) *Attorney, Agent, or Firm* — John K. Park; Park Law Firm

(57) ABSTRACT

In regards to the invention titled "External Wall Panel Unit for Saving Energy and External Wall Structure System Using the Same," there are an external wall panel unit and an external wall structure system for saving energy.

The external wall panel unit is attached to an external wall structure (1) of a building to form an external wall of the building, and includes: an external frame (10); a frame rain-water tube (20); a frame duct (30); and a window (40).

The external wall structure system using the external wall panel units is installed in such a way that a plurality of the external wall panel units are arranged and mounted vertically and horizontally.

10 Claims, 5 Drawing Sheets

EXTERNAL WALL PANEL UNIT FOR SAVING ENERGY AND EXTERNAL WALL STRUCTURE SYSTEM USING THE SAME

BACKGROUND OF THE INVENTION

1. Field of the Invention

The present invention relates to an external wall of a building, and more particularly, to external wall panel units for saving energy and an external wall structure system using the same, which can recycle rainwater after collecting rainwater from the external wall of the building, reduce temperature of the external wall, discharge out heated air inside the external wall and effectively discharge out exhaust indoor air through a duct, and function as an awning according to a direction of the sun.

2. Background Art

Recently, many new tall buildings have been built in order to accommodate many persons and facilities in a limited or small site.

An RC structure and an SRC structure have been widely used to build such tall buildings, and the SRC structure mainly takes curtain walls for the external wall.

The curtain wall is typically comprised of external wall units mainly made of glass, metal or stone.

Such curtain walls have several problems in that it increases carbon emissions and is uneconomical since there is a need to operate a cooling system because of a sudden rise of the indoor temperature of the building in the summer season with a lot of sunshine and high outdoor temperature and there is a need to operate a heating system because of a sudden drop in the indoor temperature of the building in the winter season with reduced sunshine or low outdoor temperature.

Furthermore, recently, there are many attempts to collect rainwater in case of rain to use it as toilet water or ornamental water so as to reduce carbon emissions on the basis of green growth.

However, till now, there have been made attempts to collect rainwater on the roof or the rooftop of a building but there does not have been made any attempts to collect a lot of rainwater flowing along the external wall of the building.

SUMMARY OF THE INVENTION

Accordingly, the present invention has been made to solve the above-mentioned problems occurring in the prior arts, and it is an object of the present invention to provide external wall panel units for saving energy and an external wall structure system using the same, which can recycle rainwater after collecting rainwater from the external wall of the building, reduce temperature of the external wall, discharge out heated air inside the external wall and effectively discharge out exhaust indoor air through a duct, and function as an awning according to a direction of the sun.

To accomplish the above object, according to the present invention, there is provided an external wall panel unit, which attached to an external wall structure of a building to form an external wall of the building, comprising: an external frame attached to the external wall structure and formed in a close curve in such a way that a square tube having a space therein is bent and both ends of the square tube are bonded, the external frame having a slit for allowing introduction and evaporation of rainwater, the slit being formed on an outer face of an upper portion of the bottom thereof; a frame rainwater tube mounted inside the bottom of the external frame and inclinedly mounted beneath the slit, the frame rainwater tube having a hole at an upper portion thereof; a frame duct being parallel and adjacent to the frame rainwater tube and inclinedly mounted inside the bottom of the external frame; and a window mounted on the inner face and at the center of the external frame.

Moreover, in another aspect of the present invention, there is provided an external wall structure system using the external wall panel unit for saving energy, in which a plurality of the external wall panel units for saving energy are arranged and mounted vertically and horizontally in such a way that the external frames are in contact with one another and that the frame rainwater tubes and the frame ducts of the external wall panel units are communicatingly connected with one another, wherein the frame rainwater tube of the external frame mounted at the uppermost floor of the building serves as a connection pipe and is connected with a rainwater tank on the rooftop, and the frame rainwater tube disposed on each floor of the building is connected with a connection pipe so as to be connected with a rainwater tank mounted on each floor inside the building in consideration of the number of floors of the building, or the frame duct is connected with a ventilation duct connected with the inside of the building.

The present invention can obtain the following effects.

First, because the external wall structure system can collect rainwater from the external wall of the building, the system can recycle the collected rainwater into toilet water or ornamental water, and recycle the collected rainwater into external wall cooling water to reduce a cooling load of the building by flowing the collected rainwater along the frame rainwater tube mounted on the external wall.

Second, because the frame rainwater tube and the frame duct are respectively mounted on the external wall of the building to reduce the temperature of the external wall, the present invention can reduce carbon emissions and provide economic feasibility by reducing the cooling load and improve the quality of the indoor air by effectively discharging out exhausted indoor air through the frame duct.

Third, because it is easy to previously manufacture the external wall panel units for saving energy according to the present invention in a factory and convenient to install, dismantle and maintain the external wall structure system using the external wall panel units in the field, even unskilled workers can control the quality of the system.

Fourth, the external wall panel units according to the present invention can be applied to any buildings without limitation in forms, the number of floors or sizes of buildings.

Fifth, because the projections formed on the external wall serve as awnings to control sunshine according to sunlight directions, the present invention can reduce the cooling load and enhance the quality of housing environments.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 1:
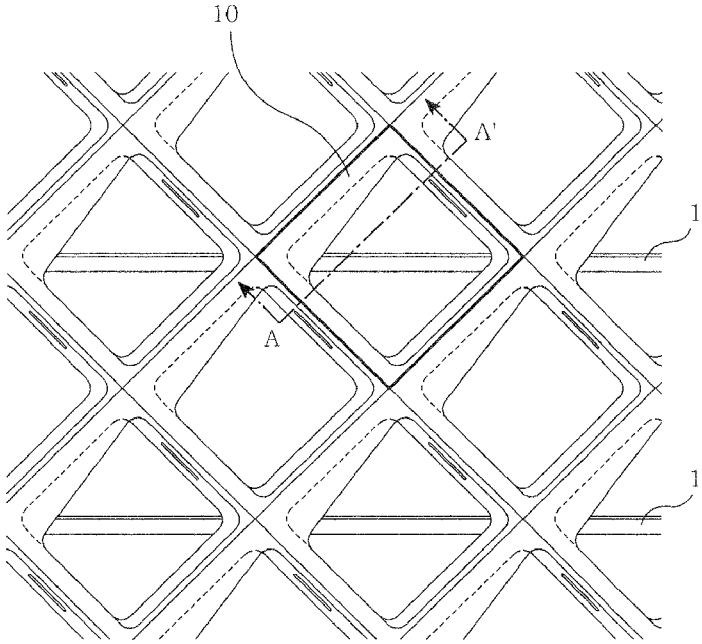
FIG. 1 illustrates external wall panel units for saving energy and an external wall structure system using the external wall panel units, which are installed on an external wall of a building.
Figure 2:
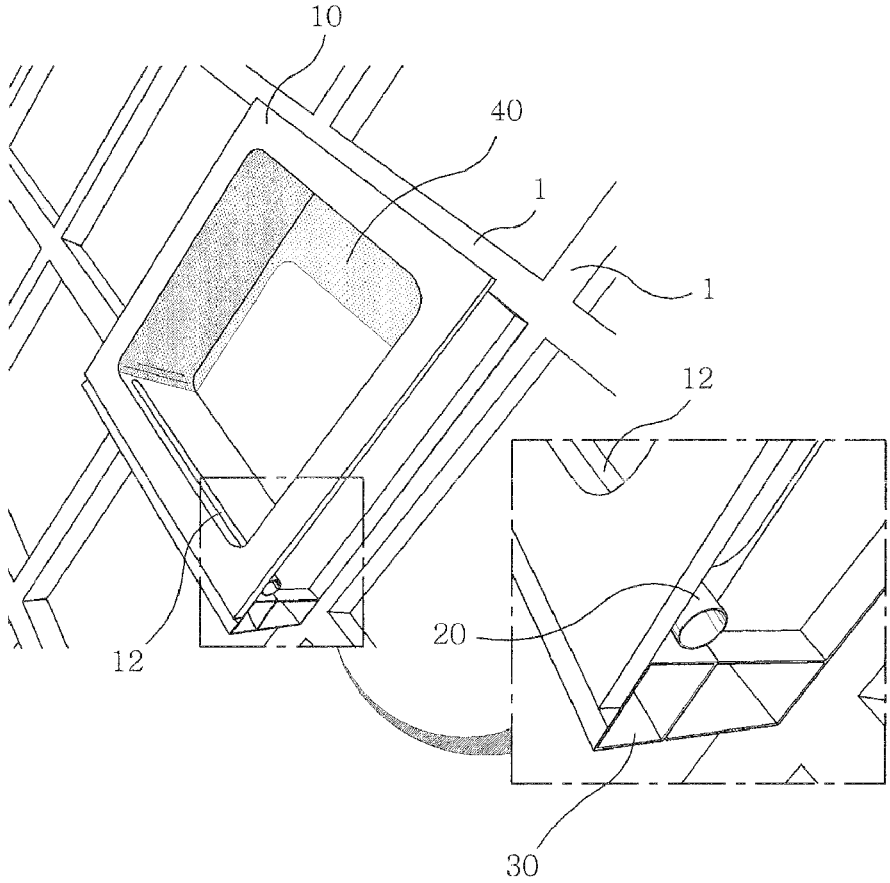
FIG. 2 is an exploded perspective view and a partially enlarged view of the external wall panel units for saving energy and the external wall structure system using the external wall panel units, which are installed on the external wall of the building.
Figure 3:
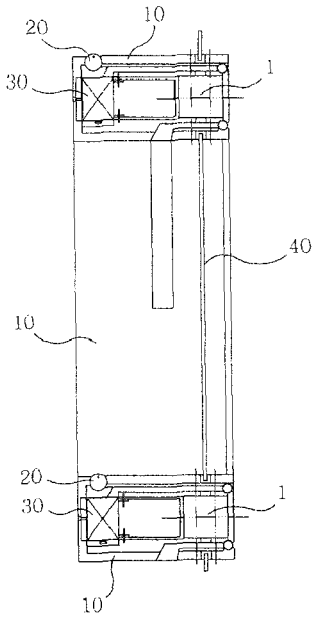
FIG. 3 is a sectional view taken along the line of A-A' of FIG. 1.

FIG. 1 illustrates external wall panel units for saving energy and an external wall structure system using the external wall panel units, which are installed on an external wall of a building, FIG. 2 is an exploded perspective view and a partially enlarged view of the external wall panel units for saving energy and the external wall structure system using the external wall panel units, which are installed on the external wall of the building, and FIG. 3 is a sectional view taken along the line of A-A' of FIG. 1.

The external wall panel units for saving energy according to the present invention are attached to an external wall structure 1 of a building to form an external wall of the building, and each of the external wall panel units includes: an external frame 10 attached to the external wall structure 1 and formed in a close curve in such a way that a square tube having a space therein is bent and both ends of the square tube are bonded, the external frame 10 having a slit 12 formed on an outer face of an upper portion of the bottom thereof for allowing introduction and evaporation of rainwater; a frame rainwater tube 20 mounted inside the bottom of the external frame 10 and inclinedly mounted beneath the slit 12, the frame rainwater tube 20 having a hole at an upper portion thereof; a frame duct 30 being parallel and adjacent to the frame rainwater tube 20 and inclinedly mounted inside the bottom of the external frame 10; and a window 40 mounted on the inner face and at the center of the external frame 10.

The external frame 10 is attached to the external wall structure 1 and formed in a closed curve in such a way in such a way that a square tube having a space therein is bent and both ends of the square tube are bonded and has the slit 12 formed on the outer face of the upper portion of the bottom thereof for allowing introduction and evaporation of rainwater, and hence, it has a form similar to general window frames. It is preferable that the external frame 10 is mainly made of ferrous or non-ferrous metals, such as aluminum, in consideration of durability, but any materials, which can ensure convenience in manufacturing and construction work, for instance, synthetic resin, can be used.

Furthermore, an overall shape of the external frame 10 is one of a square, a rectangle, a diamond, a circle and an oval. However, the external frame 10 is not limited to the above shapes, and can take any shape if the frame rainwater tube 20 and the frame duct 30 can be mounted inside the external frame 10 in such a way as to keep inclination for allowing a flow of water and air.

A part of the external frame 10, which directs the sunlit path, may protrude outwardly from the building or toward another external frame 10 facing the above external frame 10 so as to serve as an awning to screen the sun.

The external frame 10 is attached to the external wall structure 1 in such a way as to surround or to be in close contact to the external wall structure 1 using conventional means, such as angles or fasteners.

The frame rainwater tube 20, which is inclinedly mounted beneath the slit 12 inside the bottom of the external frame 10 and has a hole at the upper portion thereof, serves to collect rainwater, which is introduced into the slit 12 in case of rain, into the hole. Moreover, the frame rainwater tube 20 may have a spiral groove or an uneven form on the inner face thereof. The spiral groove or the uneven form serves to reduce noise and the speed of running rainwater when the rainwater introduced into the frame rainwater tube 20 passes through the frame rainwater tube 20, such that the spiral groove or the uneven form can prevent a spatter of the rainwater out of the frame rainwater tube 20 and help the running rainwater evaporate effectively.

The frame duct 30, which is parallel and adjacent to the frame rainwater tube 20 and inclinedly mounted inside the bottom of the external frame 10, serves to upwardly discharge out the air heated on the external wall of the building or to discharge out exhausted indoor air together with the rising air, which is heated inside the external wall of the building, upwardly along the external wall of the building.

It is preferable that the window 40, which is mounted on the inner face and at the center of the external frame 10, is insulating glass used generally. Additionally, ventilating and air-exhausting means used generally in conventional curtain walls may be partially disposed at a portion of the external frame 10 where the window 40 is bonded.

For the external wall structure system for saving energy according to the present invention, a plurality of the external wall panel units for saving energy are arranged and mounted vertically and horizontally in such a way that the external frames 10 are in contact with one another and that the frame rainwater tubes 20 and the frame ducts 30 of the external wall panel units are communicatingly connected with one another.

The frame rainwater tube 20 of the external frame 10 mounted at the uppermost floor of the building serves as a connection pipe 50' and is connected with a rainwater tank 70' on the rooftop. Moreover, the frame rainwater tube 20 disposed on each floor of the building is connected with a connection pipe 50 so as to be connected with a rainwater tank 70 mounted on each floor inside the building in consideration of the number of floors of the building, or the frame duct 30 may be connected with a ventilation duct connected with the inside of the building.

Figure 4A:
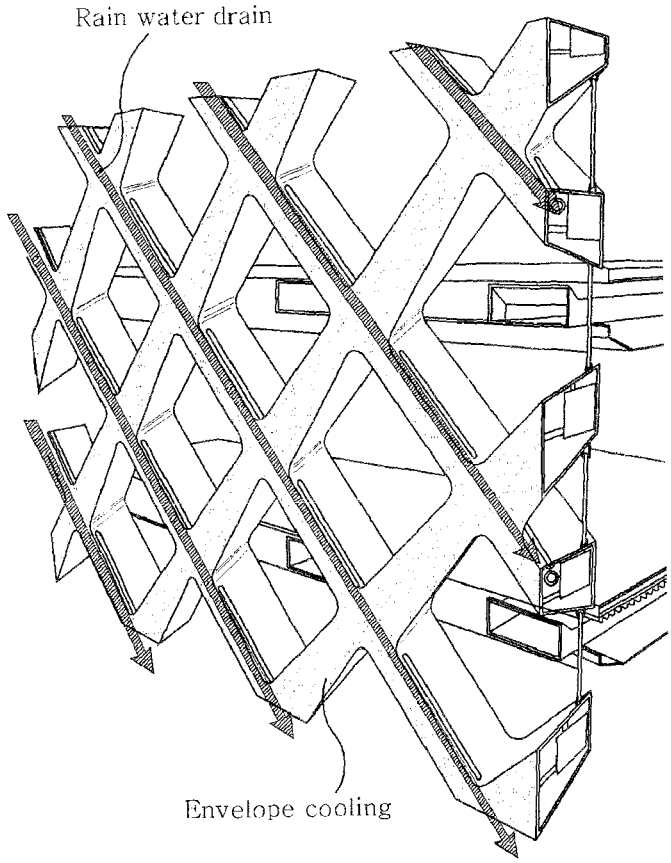
FIG. 4*a* is a conceptual diagram showing a process of collecting rainwater by the external wall structure system using the external wall panel units according to the present invention.
Figure 4B:
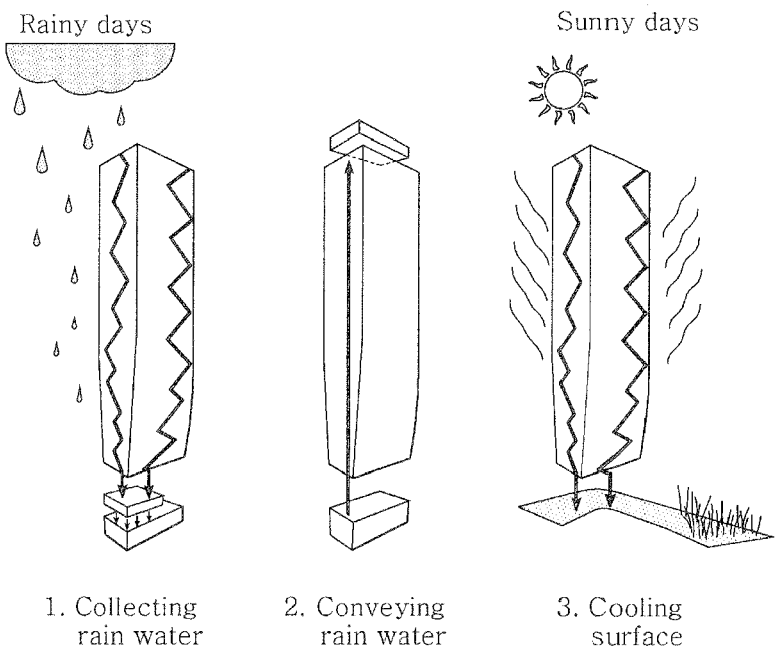
FIG. 4*b* is a conceptual diagram showing a process of collecting rainwater and cooling the external wall by the external wall structure system using the external wall panel units.
Figure 6:
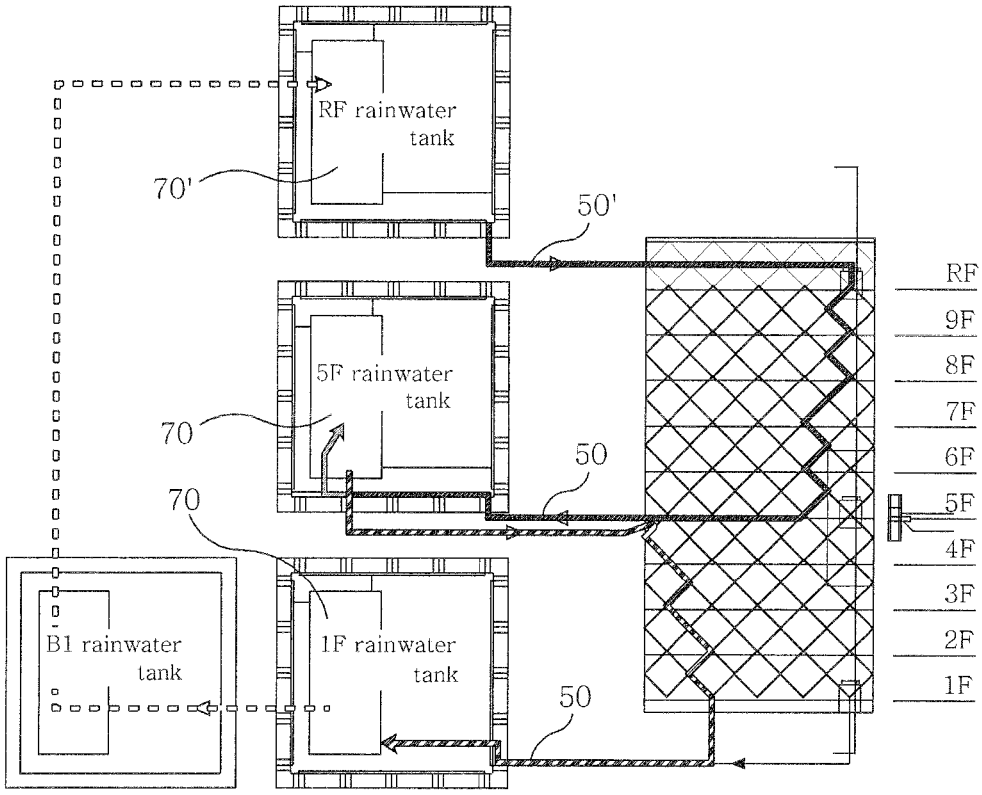
FIG. 6 is a conceptual diagram showing a process of collecting rainwater from the external wall into rainwater tanks of the external wall structure system.

FIG. 4*a* is a conceptual diagram showing a process of collecting rainwater by the external wall structure system using the external wall panel units according to the present invention, FIG. 4*b* is a conceptual diagram showing a process of collecting rainwater and cooling the external wall by the external wall structure system using the external wall panel units, and FIG. 6 is a conceptual diagram showing a process of collecting rainwater from the external wall into rainwater tanks of the external wall structure system.

As shown in FIGS. 4*a* and 4*b* and 6, rainwater introduced into the slit 12 in case of rain can be connected in the rainwater tank 70 through the frame rainwater tube 20 and the connection pipe 50 connected to the frame rainwater tube 20, and the collected rainwater can be reused as toilet water, ornamental water, or cooling water for cooling the external wall. Furthermore, on a clear day with high temperature, the external wall structure system can provide a cooling effect to cool the building by flushing out the rainwater, which is stored in the rainwater tank 70' on the rooftop or the rainwater tank 70 installed inside the building, through the frame rainwater tube 20 to cool down the external wall.

Referring to FIGS. 4*b* and 6, the process of cooling the external wall of the building will be described in more detail.

The process of cooling the external wall of the building includes the steps of: (1) collecting rainwater in the rainwater tank 70 installed inside the building and/or an underground rainwater tank 70; (2) conveying the rainwater collected in the rainwater tank 70 to the rainwater tank 70' on the rooftop; and (3) cooling the external wall of the building by flushing out the rainwater collected and stored in the rainwater tank 70' in hot weather.

Figure 5A:
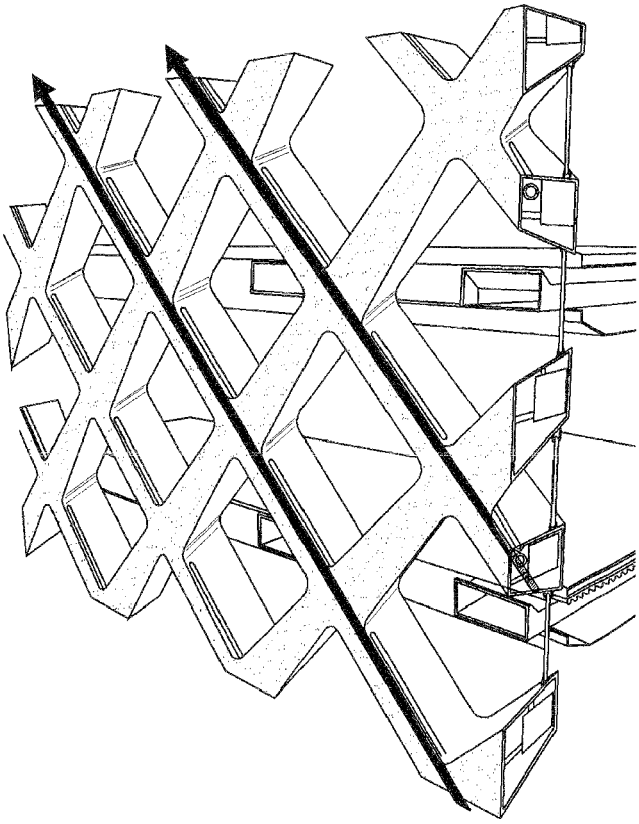
FIG. 5*a* is a conceptual diagram showing a process of discharging out heated air in the external wall structure system using the external wall panel units.
Figure 5B:
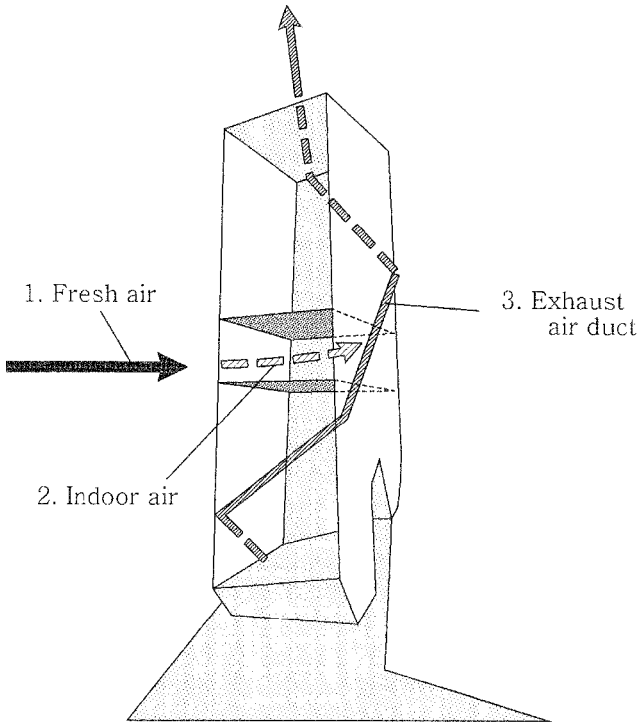
FIG. 5*b* is a conceptual diagram showing a process of discharging out the heated air, cooling the external wall of the building, and naturally discharging exhausted indoor air along an ascending air current to thereby improve the quality of the indoor air.

FIG. 5*a* is a conceptual diagram showing a process of discharging out heated air in the external wall structure system using the external wall panel units, and FIG. 5*b* is a conceptual diagram showing a process of discharging out the heated air, cooling the external wall of the building, and naturally discharging exhausted indoor air along an ascending air current to thereby improve the quality of the indoor air.

The chimney effect or stack effect means the phenomenon that air existing in vertical spaces, such as staircases, pipe ducts, elevator hoistways, and so on, ascends or descends sharply by a density difference between the indoor air and the outdoor air of the vertical spaces.

The external wall structure system using the external wall panel units for saving energy according to the present invention adopts the chimney effect or the stack effect to the external wall of the building, and the frame duct 30 serves as a chimney to automatically move the air of the external wall, which is heated by solar-radiation energy, to the upper portion of the building using a convection current. Accordingly, the external wall structure system can naturally discharge out the exhausted indoor air more effectively than conventional systems. The frame duct 30 may be connected with the inside of the building through the ventilation duct to discharge out the heated and exhausted indoor air. Furthermore, if an air-conditioning facility, such as an exhaust motor, is additionally mounted on the frame duct 30 on each floor, the chimney effect or the stack effect can be increased.

Figure 7:
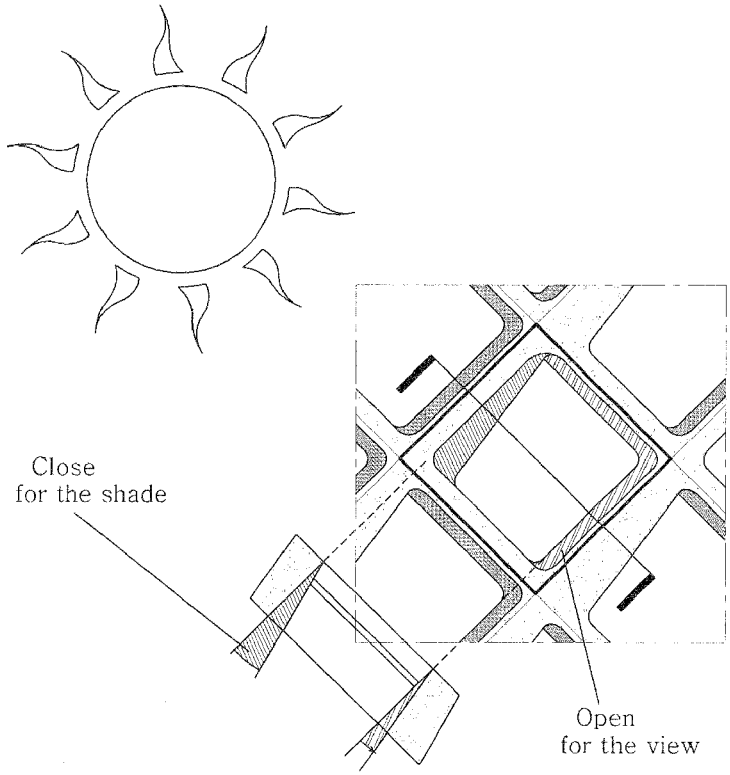
FIG. 7 is a conceptual diagram showing a state where an external frame serves as an awning according to sunlight directions.
Figure 8:
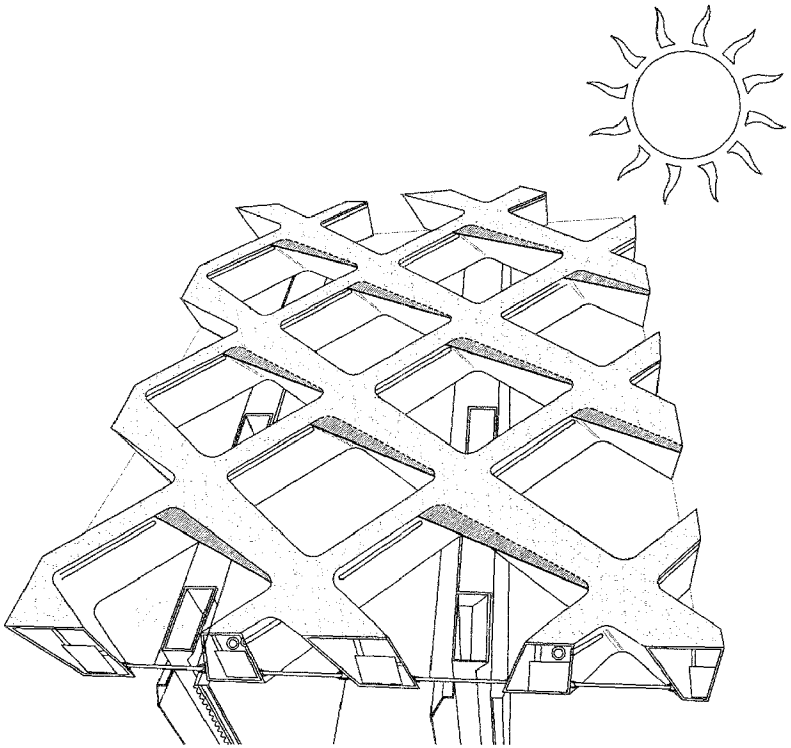
FIG. 8 is another conceptual diagram showing the state where the external frame serves as the awning according to sunlight directions.

FIG. 7 is a conceptual diagram showing a state where an external frame serves as an awning according to sunlight directions, and FIG. 8 is another conceptual diagram showing the state where the external frame serves as the awning according to sunlight directions.

In the external wall structure system using the external wall panel units for saving energy according to the present invention, a part of the external frame 10, which directs the sunlit path, may protrude outwardly from the building or toward another external frame 10 facing the above external frame 10 so as to serve as the awning to screen the sun.

FIGS. 7 and 8 illustrate that a part of one external frame 10 protrude toward another external frame 10 facing the above external frame 10 so as to screen the sun. As shown in the drawings, in case of Korea, in order to save energy and for the convenience of occupants in the building, it is advantageous to protrude a portion of the external frame 10 westward on the assumption that the sun is mainly located in the west, and the protruding part is also advantageous in design.

The external wall structure system using the external wall panel units for saving energy according to the present invention provides an excellent overall design since it has deep intaglio and embossment patterns on the external wall, and can control sunshine introduced into the building by adjusting sizes thereof.

The external wall structure system using the external wall panel units for saving energy according to the present invention can recycle the collected rainwater into toilet water, ornamental water, or cooling water for cooling the external wall because the system can collect rainwater from the external wall of the building, reduce the cooling load and carbon emissions because it can lower temperature of the external wall by the frame rainwater tube mounted in the external wall of the building, naturally discharge out the exhausted indoor air along the ascending air current of the air heated by the solar-radiation energy through the frame duct, which is mounted in the external wall of the building, to thereby improve the quality of the indoor air, and reduce cooling load and enhance the quality of living environment since it serves as the awning to control sunshine according to sunlight directions.

Moreover, the present invention allows even unskilled workers to control the quality of this system it is easy to previously manufacture the external wall panel units in a factory and convenient to install, dismantle and maintain the external wall structure system using the previously manufactured external wall panel units in the field.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. An external wall panel unit, which is attached to an external wall structure (1) of a building to form an external wall of the building, the external wall panel unit comprising:

an external frame (10) attached to the external wall structure (1) and formed in a close curve in such a way that a square tube having a space therein is bent and both ends of the square tube are bonded, the external frame (10) having a slit (12) for allowing introduction and evaporation of rainwater, the slit (12) being formed on an outer face of an upper portion of the bottom thereof;

a frame rainwater tube (20) mounted inside the bottom of the external frame (10) and inclinedly mounted beneath the slit (12), the frame rainwater tube (20) having a hole at an upper portion thereof;

a frame duct (30) being parallel and adjacent to the frame rainwater tube (20) and inclinedly mounted inside the bottom of the external frame (10); and a window (40) mounted on the inner face and at the center of the external frame (10).

2. The external wall panel unit according to claim 1, wherein the overall shape of the external frame (10) is a diamond or a circle.

3. The external wall panel unit according to claim 1, wherein a part of the external frame (10), protrudes outwardly so as to serve as an awning to screen the sun.

4. The external wall panel unit according to claim 1, wherein the frame rainwater tube (20) has a spiral groove or an uneven form on the inner face thereof.

5. The external wall panel unit according to claim 3, wherein the frame rainwater tube (20) has a spiral groove or an uneven form on the inner face thereof.

6. An external wall structure system using the external wall panel unit according to claim 5, wherein a plurality of the external wall panel units are arranged and mounted vertically and horizontally in such a way that the external frames (10) are in contact with one another and that the frame rainwater tubes (20) and the frame ducts (30) of the external wall panel units are communicatingly connected with one another, and wherein the frame rainwater tube (20) of the external frame (10) mounted at the uppermost floor of the building serves as a connection pipe (50') and is connected with a rainwater tank (70') on the rooftop, and the frame rainwater tube (20) disposed on each floor of the building is connected with a connection pipe (50) so as to be connected with a rainwater tank (70) mounted on each floor inside the building in consideration of the number of floors of the building, or the frame duct (30) is connected with a ventilation duct connected with the inside of the building.

7. An external wall structure system using the external wall panel unit according to claim 4, wherein a plurality of the external wall panel units are arranged and mounted vertically and horizontally in such a way that the external frames (10) are in contact with one another and that the frame rainwater tubes (20) and the frame ducts (30) of the external wall panel units are communicatingly connected with one another, and wherein the frame rainwater tube (20) of the external frame (10) mounted at the uppermost floor of the building serves as a connection pipe (50') and is connected with a rainwater tank (70') on the rooftop, and the frame rainwater tube (20) disposed on each floor of the building is connected with a connection pipe (50) so as to be connected with a rainwater tank (70) mounted on each floor inside the building in consideration of the number of floors of the building, or the frame duct (30) is connected with a ventilation duct connected with the inside of the building.

8. An external wall structure system using the external wall panel unit according to claim 3, wherein a plurality of the external wall panel units are arranged and mounted vertically and horizontally in such a way that the external frames (10) are in contact with one another and that the frame rainwater tubes (20) and the frame ducts (30) of the external wall panel units are communicatingly connected with one another, and wherein the frame rainwater tube (20) of the external frame (10) mounted at the uppermost floor of the building serves as a connection pipe (50') and is connected with a rainwater tank (70') on the rooftop, and the frame rainwater tube (20) disposed on each floor of the building is connected with a connection pipe (50) so as to be connected with a rainwater tank (70) mounted on each floor inside the building in consideration of the number of floors of the building, or the frame duct (30) is connected with a ventilation duct connected with the inside of the building.

9. An external wall structure system using the external wall panel unit according to claim 2, wherein a plurality of the external wall panel units are arranged and mounted vertically and horizontally in such a way that the external frames (10) are in contact with one another and that the frame rainwater tubes (20) and the frame ducts (30) of the external wall panel units are communicatingly connected with one another, and wherein the frame rainwater tube (20) of the external frame (10) mounted at the uppermost floor of the building serves as a connection pipe (50') and is connected with a rainwater tank (70') on the rooftop, and the frame rainwater tube (20) disposed on each floor of the building is connected with a connection pipe (50) so as to be connected with a rainwater tank (70) mounted on each floor inside the building in consideration of the number of floors of the building, or the frame duct (30) is connected with a ventilation duct connected with the inside of the building.

10. An external wall structure system using the external wall panel unit according to claim 1, wherein a plurality of the external wall panel units are arranged and mounted vertically and horizontally in such a way that the external frames (10) are in contact with one another and that the frame rainwater tubes (20) and the frame ducts (30) of the external wall panel units are communicatingly connected with one another, and wherein the frame rainwater tube (20) of the external frame (10) mounted at the uppermost floor of the building serves as a connection pipe (50') and is connected with a rainwater tank (70') on the rooftop, and the frame rainwater tube (20) disposed on each floor of the building is connected with a connection pipe (50) so as to be connected with a rainwater tank (70) mounted on each floor inside the building in consideration of the number of floors of the building, or the frame duct (30) is connected with a ventilation duct connected with the inside of the building.

* * * * *